US005832732A

United States Patent [19]

Knöpfel et al.

[11] Patent Number: 5,832,732

[45] Date of Patent: Nov. 10, 1998

[54] COMBUSTION CHAMBER WITH AIR INJECTOR SYSTEMS FORMED AS A CONTINUATION OF THE COMBUSTOR COOLING PASSAGES

[75] Inventors: Hans Peter Knöpfel, Besenbüren, Switzerland; Peter Senior, Countesthorpe, United Kingdom

[73] Assignee: ABB Research Ltd., Zurich, Switzerland

[21] Appl. No.: 662,798

[22] Filed: Jun. 12, 1996

[30] Foreign Application Priority Data

Jun. 26, 1995 [DE] Germany ..... 195 23 094.9

[51] Int. Cl.[6] ..... F23R 3/52

[52] U.S. Cl. ..... 60/760; 60/737; 60/748; 431/243

[58] Field of Search ..... 60/737, 722, 748, 60/760, 39.49, 39.07; 431/243, 353

[56] References Cited

U.S. PATENT DOCUMENTS

| | | | |
|---|---|---|---|
| 2,621,477 | 12/1952 | Powter et al. . | |
| 3,751,991 | 8/1973 | De Tartaglia | 60/760 |
| 3,859,786 | 1/1975 | Azelborn et al. | 60/39.65 |
| 4,244,179 | 1/1981 | Kainov et al. . | |
| 4,561,841 | 12/1985 | Korenyi | 431/265 |
| 4,651,534 | 3/1987 | Stroem . | |
| 4,875,339 | 10/1989 | Rasmussen et al. . | |
| 4,887,432 | 12/1989 | Mumford et al. | 60/760 |
| 5,081,843 | 1/1992 | Ishibashi et al. | 60/737 |
| 5,118,283 | 6/1992 | Sattelmayer | 431/243 |
| 5,373,695 | 12/1994 | Aigner et al. | 60/39.36 |
| 5,423,674 | 6/1995 | Knopfel et al. | 431/9 |
| 5,490,388 | 2/1996 | Althaus et al. | 60/737 |
| 5,557,921 | 9/1996 | Frutschi et al. | 60/39.53 |
| 5,569,020 | 10/1996 | Griffin et al. | 431/7 |
| 5,584,182 | 12/1996 | Althaus et al. | 60/737 |
| 5,588,826 | 12/1996 | Dobbeling et al. | 431/354 |

FOREIGN PATENT DOCUMENTS

| | | | |
|---|---|---|---|
| 110333 | of 1961 | Czechoslovakia | 60/760 |
| 4232442A1 | 3/1994 | Germany . | |
| 555648 | 6/1957 | Italy | 60/39.07 |

*Primary Examiner*—Timothy Thorpe
*Assistant Examiner*—Ted Kim
*Attorney, Agent, or Firm*—Burns, Doane, Swecker & Mathis, L.L.P.

[57] ABSTRACT

In an annular combustion chamber (1), which essentially comprises a plenum (7) for receiving a compressor air flow, burners (100) placed inside the plenum (7), a combustion space (122) arranged downstream of the plenum (7), and a cooling-air-carrying duct (2, 3) encasing the combustion space (122) and leading into the plenum (7), injector systems (8, 9) are arranged in the region where the coolingair-carrying duct (2, 3) leads into the plenum (7). These injector systems (8, 9) in each case consist of a flow duct as a continuation of the cooling-air-carrying duct (2, 3) and of a number of openings (5*a*) which are arranged in the peripheral direction of this flow duct and through which acceleration air (5) flows into the cooling-air flow. The effect of a bodiless diffuser is thereby achieved, and the pressure losses which occur given a widening in cross section are minimized.

23 Claims, 8 Drawing Sheets

COMBUSTION CHAMBER WITH AIR INJECTOR SYSTEMS FORMED AS A CONTINUATION OF THE COMBUSTOR COOLING PASSAGES

BACKGROUND OF THE INVENTION

1. Field of the Invention

The present invention relates to a combustion chamber.

2. Discussion of Background

In the modern generation of gas turbines, some of the compressor air is diverted for cooling purposes. In accordance with the intended use, this compressor air is used for cooling the units subjected to high thermal loading and is then subsequently introduced as combustion air into the cycle of the gas turbine. Since the cooling air has to be introduced into the cycle at a suitable point, there is at this point the inherent risk of high pressure losses, which inevitably results in a reduction in the efficiency of the plant. Furthermore, the said compressor air has to be returned to the cycle again in front of the combustion zone, for example after cooling the combustion chamber, if the specific output of the plant is not to suffer. In connection with the use of a premix burner in the combustion chamber, as far as apparent from the prior art, pressure losses occur, especially during the last-mentioned operation, which regularly lead to considerable losses in efficiency as a result of the widening in cross-section between cooling-air feed and plenum. It is certainly true that these losses in efficiency can be avoided by a diffuser; however, such a measure, in particular in the case of today's conventional annular combustion chambers, would cause a considerable increase in the length of the gas turbine with all the disadvantages resulting therefrom, which are most familiar to the person skilled in the art. These disadvantages would then come to the fore if the gas turbine is designed for sequential combustion, i.e. if the gas turbine consists two combustion chambers and two turbines each arranged downstream. The disclosed configurations which attempt to reduce the overall length of the gas turbine on account of an excessive length of the combustion chamber by superimposing the combustion chamber relative to the two interacting turbomachines also have disadvantages, for here the direction of flow of the working media has to be deflected twice in each case, which does not promote the efficiency or the quality of the mixing of the combustion air.

SUMMARY OF THE INVENTION

Accordingly, one object of the invention as defined in the claims, in a combustion chamber of the type mentioned at the beginning, is to introduce the cooling air into the combustion-air flow with minimized pressure losses during optimum mixing of the two air flows.

The pressure losses during the introduction of the cooling air into the combustion-air flow are minimized by a bodiless diffuser being formed by at least one injector system at the transition to the plenum per se.

The essential advantage of the invention may be seen in the fact that this is a compact configuration which ensures the inflow of the cooling air into the other air flow within the same limits as during the use of a relatively long transition diffuser designed for optimum flow. This results in it being possible for the combustion chamber to be of more compact design and in the admixing of the cooling air taking place in a fluidically optimum manner in such a way that the flame temperature can be influenced so as to minimize the pollutant emissions, in particular as far as the NOx emissions are concerned.

In addition, not only are the pressure losses minimized by the invention but the suppression of pulsations is also influenced in a positive manner.

The invention exhibits considerable advantages in particular in gas turbines having annular combustion chambers, for the proposed admixing of the cooling air does not necessitate an extension of the plenum, the obvious result of which is a shorter rotor shaft of the plant.

Advantageous and expedient further developments of the achievment of the solution according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
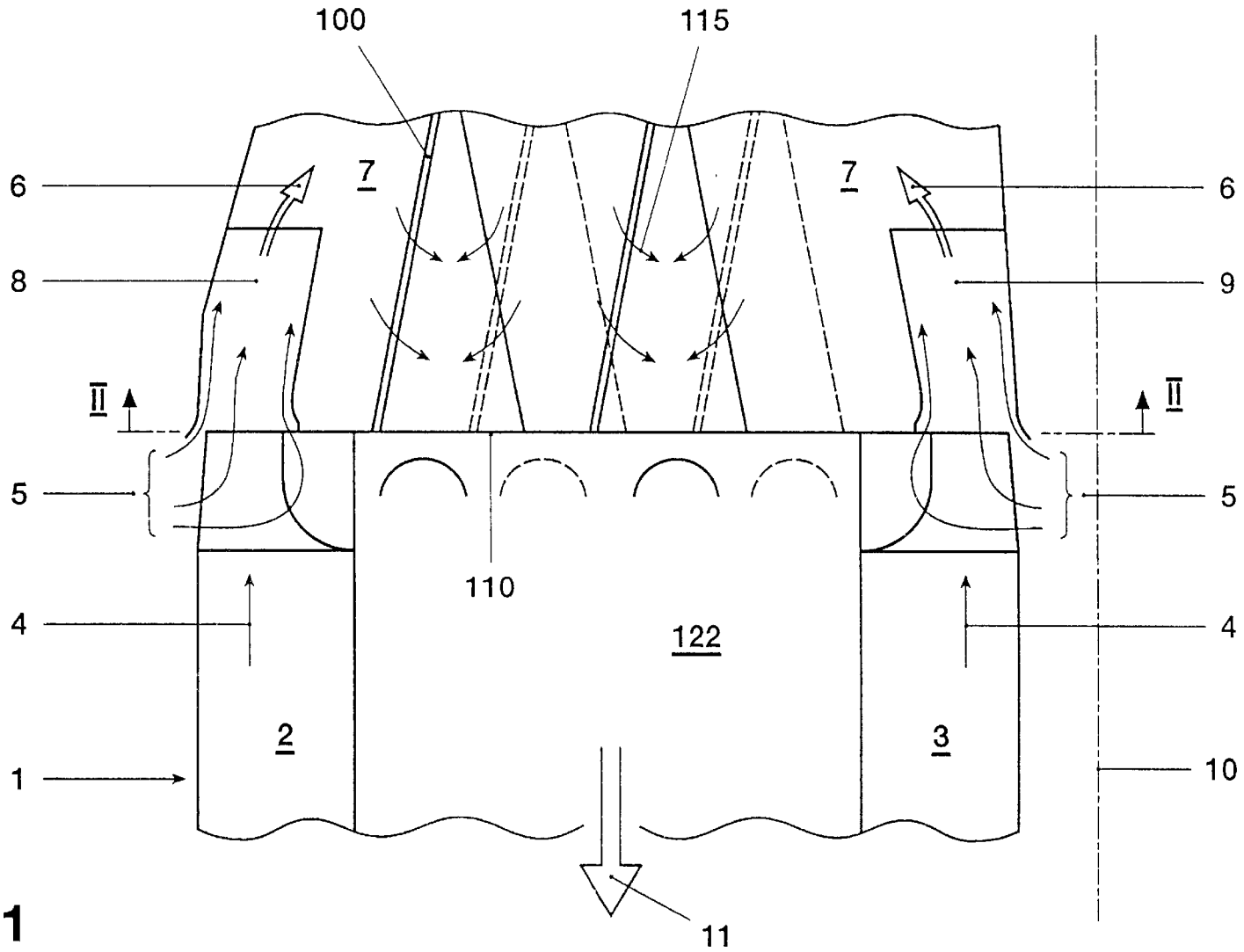
FIG. 1 shows an annular combustion chamber in the region where the cooling air is introduced into the combustion-air flow.

Referring now to the drawings, like reference numerals designate identical or corresponding parts throughout the several views, all elements not required for directly understanding the invention have been omitted, and the direction of flow of the media is indicated by arrows. FIG. 1, as apparent from the shaft axis 10 shown in the drawing, shows that the present combustion chamber is an annular combustion chamber 1 which essentially assumes the form of a continuous annular or quasi-annular cylinder. In addition, such a combustion chamber may also consist of a number of axially, quasi-axially or helically arranged and individually self-contained combustion spaces. Such a combustion chamber per se may also consist of a single tube. Furthermore, this combustion chamber may form the single combustion stage of a gas turbine or a combustion stage of a sequentially fired plant. On the head side, the annular combustion chamber 1 consists of a plenum 7 which terminates at the end in the direction of flow with a configuration of burners 100. The distribution and design of the burners 100 will be dealt with in more detail in the subsequent figures. The actual combustion space 122 of the combustion chamber 1 follows downstream of these burners 100. The hot gases 11 produced in this space are then admitted as a rule to a turbine arranged downstream. The combustion space 122 is encased by a double annular duct 2, 3 through which cooling air 4 flows in counterflow direction. Approximately in the plane between the end of the burners 100 and the start of the combustion space 122, that is in the plane of the front wall 110, this cooling air 4 interacts with an air quantity 5 of higher potential coming from outside, referred to below as acceleration air, the interaction of these two air flows 4, 5 taking place via injector systems 8, 9, which are arranged in the peripheral direction opposite the inner and outer wall of the annular combustion chamber 1. The design of these injector systems will be dealt with in more detail under FIG. 2. Within these injector systems 8, 9, the cooling air 4 is given a spatially compact, optimum velocity profile within a very short distance due to the action of the acceleration air 5, which velocity profile typically corresponds to that of a relatively long diffuser. This velocity profile exhibits no flow separation along the walls of the corresponding injector system, with the result that the pressure losses, which occur in an especially virulent manner at every widening in cross-section, are minimized when this air flow 6 is subsequently introduced into the further compressor air within the plenum 7. It also follows from this that uniform combustion air 115 is provided from the mixing of the two last-mentioned main air flows in such a way that the burners 100 are loaded with optimum combustion air 115, as a result of which the subsequent mixing with a fuel to form an ignitable mixture can take place under the best possible conditions. The subsequent combustion is then logically distinguished by a minimized discharge of pollutant emissions. The burners used here are preferably constructed according to a premix technique, and diffusion burners may also be suitable for certain applications.

Figure 2:
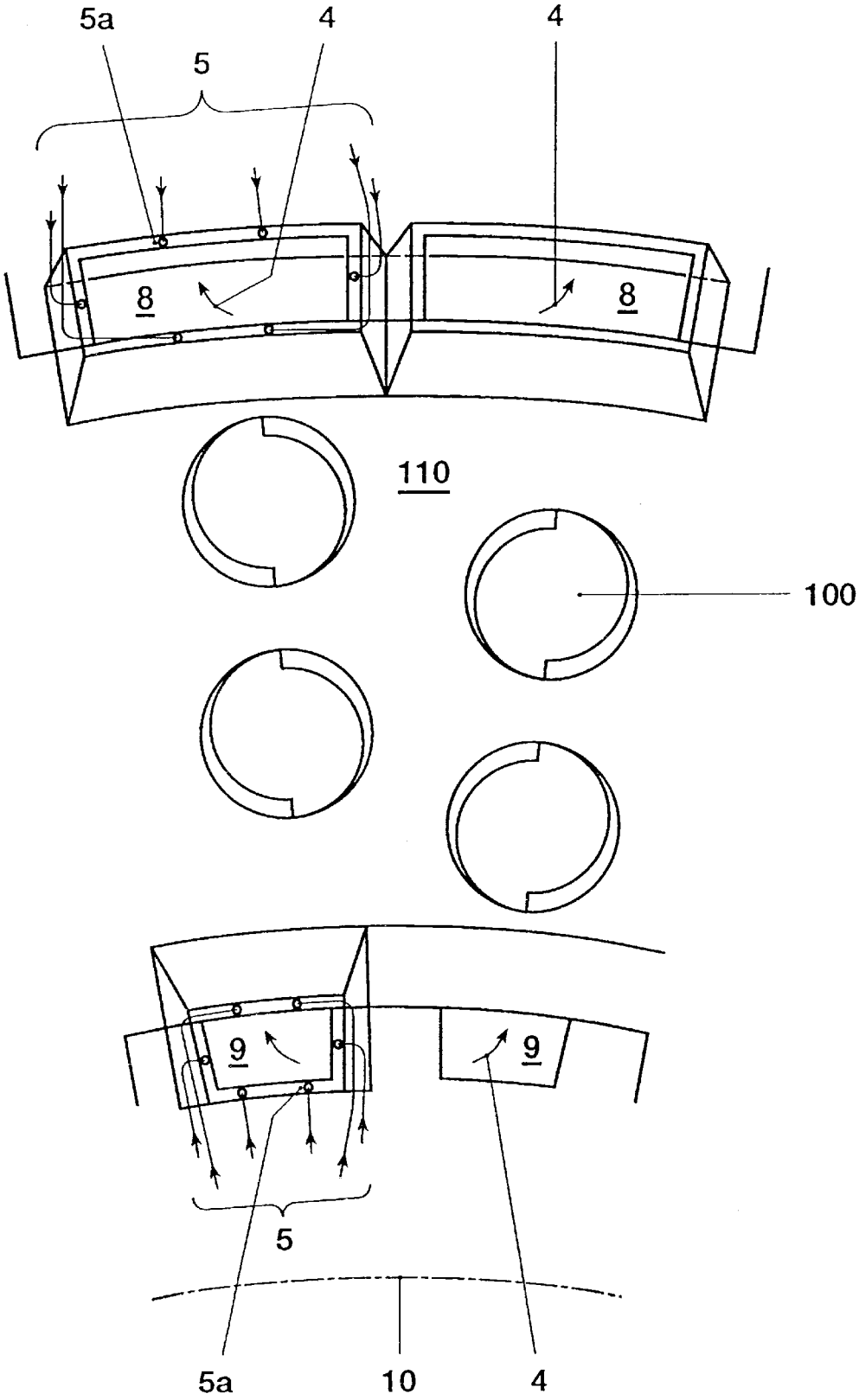
FIG. 2 shows a view of the annular combustion chamber along section plane II—II from FIG. 1.

The construction of the individual injector systems 8, 9 is apparent from FIG. 2. The arrangement of the burners 100 within the front wall 110 leading to the adjoining combustion space is also apparent from FIG. 2. This arrangement may vary from case to case, it being possible for the number of burners to vary, too. Furthermore, a division into pilot burners and main burners preferably takes place within the burner combination, as a result of which the transient load ranges can be started in an optimum manner with this measure. In both peripheral directions on either side of the burners 100, the cooling air 4 is directed by individual self-contained injector systems 8, 9 which have the form of rectangular ducts. In the peripheral direction of each duct, the acceleration air 5 is introduced via bores 5*a* present there at regular distances apart and results in the cooling air 4 being given an optimum velocity profile within the very short length of the ducts before it flows into the plenum. Of course, the geometrical cross-sectional shape of the ducts is not restricted to the rectangular shape shown. The cross-section of flow and finally the number of these ducts in the peripheral direction are also to be determined from case to case, the aim for each design necessarily being to optimize the velocity profile of the cooling air 4 within a very short distance.

Two premix burner types are shown and explained in more detail below: on the one hand a premix burner 100 according to FIGS. 3–6, which has already been shown schematically in FIGS. 1 and 2, and on the other hand a further premix burner which is shown and explained in more detail in FIGS. 7–12.

Figure 3:
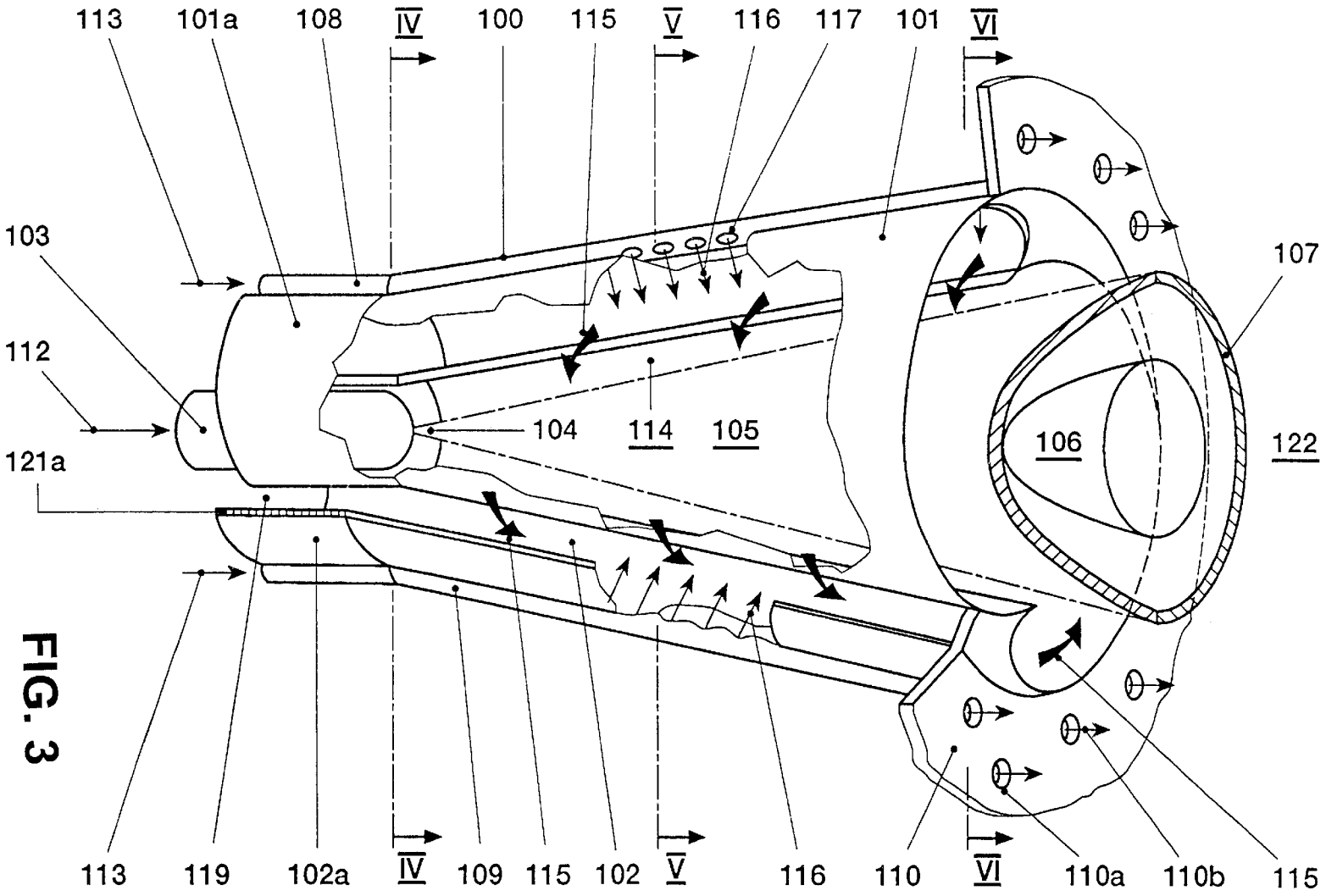
FIG. 3 shows a premix burner in perspective representation and appropriate cut-away section.
Figure 4:
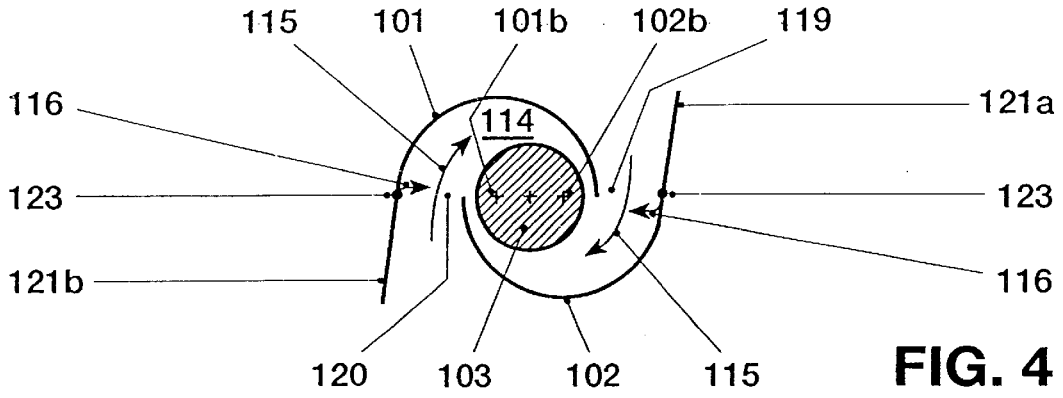
FIGS. 4–6 show views through various section planes of the burner according to FIG. 3.
Figure 5:
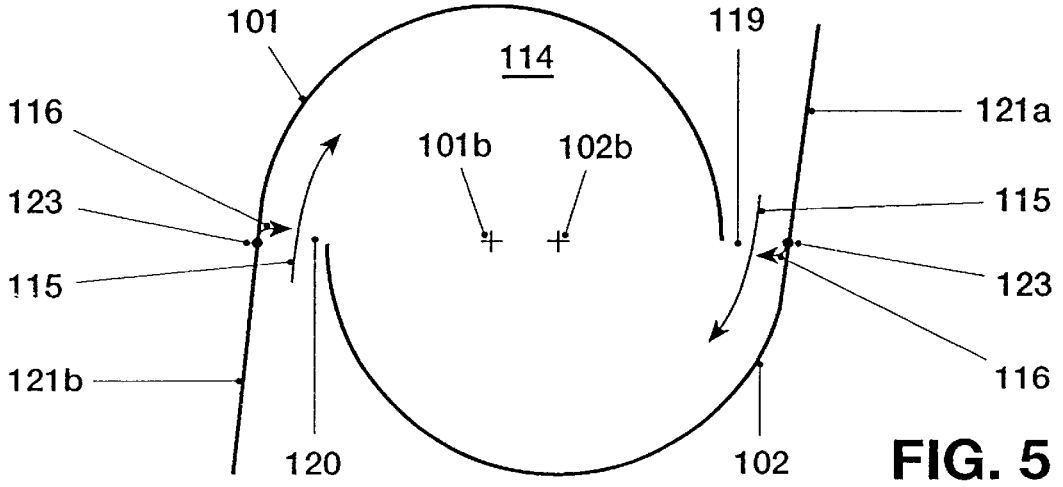
Figure 6:
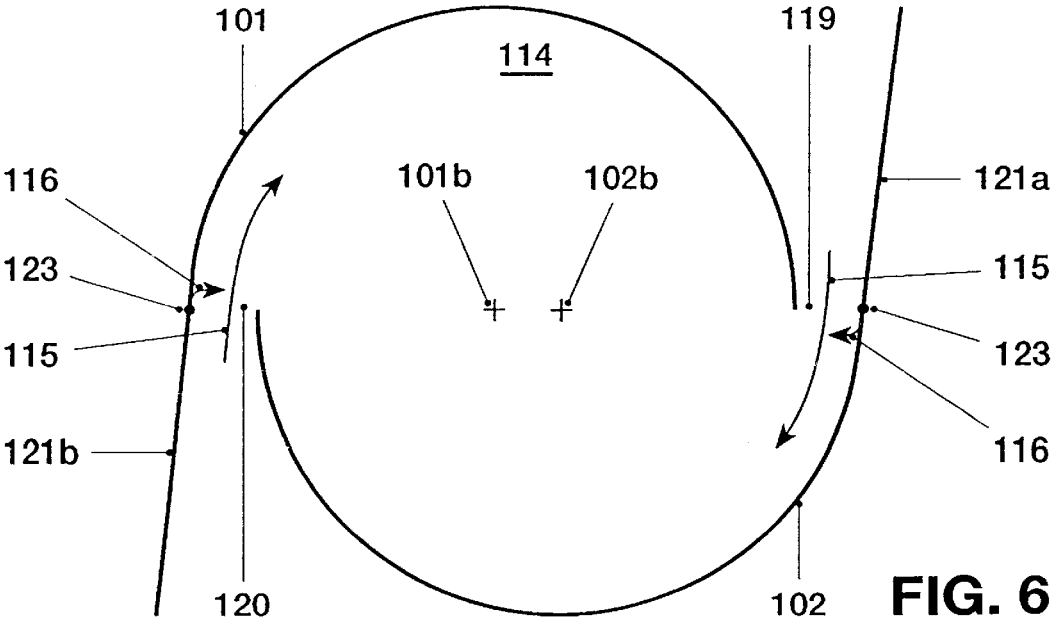

In order to better understand the construction of the burner 100, it is advantageous if the individual sections according to FIGS. 4–6 are used at the same time as FIG. 3. Furthermore, so that FIG. 3 is not made unnecessarily complex, the baffles plates 121*a*, 121*b* shown schematically according to FIGS. 4–5 are only alluded to in FIG. 3. In the description of FIG. 3, the remaining FIGS. 4–6 are referred to below when required.

The burner 100 according to FIG. 3 is a premix burner and consists of two hollow conical sectional bodies 101, 102 which are nested one inside the other in a mutually offset manner. The mutual offset of the respective center axis or longitudinal symmetry axes 101*b*, 102*b* of the conical sectional bodies 101, 102 provides on both sides, in mirror-image arrangement, one tangential air-inlet slot or duct 119, 120 each (cf. FIGS. 4–6), through which the combustion air 115 flows into the interior space of the burner 100, i.e. into the conical hollow space 114. The conical shape of the sectional bodies 101, 102 shown has a certain fixed angle in the direction of flow. Of course, depending on operational use, the sectional bodies 101, 102 may have an increasing or decreasing conicity in the direction of flow, similar to a trumpet or tulip or respectively a diffuser or confuser. The two last-mentioned shapes are not shown graphically, since they can readily be imagined by a person skilled in the art. The two conical sectional bodies 101, 102 each have a cylindrical initial part 101*a*, 102*a*, which parts likewise run offset from one another in a manner analogous to the conical sectional bodies 101, 102, with the result that the tangential air-inlet slots 119, 120 are present over the entire length of the burner 100. Accommodated in the region of the cylindrical initial part is a nozzle 103, the fuel injection 104 of which coincides approximately with the narrowest cross-section of the conical hollow space 114 formed by the conical sectional bodies 101, 102. The injection capacity of this nozzle 103 and its type depend on the predetermined parameters of the respective burner 100. The burner 100 may of course be designed to be purely conical, that is without cylindrical initial parts 101*a*, 102*a*, from a single sectional body having a single tangential air-inlet slot or from more than two sectional bodies. Furthermore, the conical sectional bodies 101, 102 each have a fuel line 108, 109, which lines are arranged along the tangential air-inlet slots 119, 120 and are provided with injection openings 117, through which preferably a gaseous fuel 113 is injected into the combustion air 115 flowing through there, as the arrows 116 are intended to symbolize. These fuel lines 108, 109 are preferably positioned at the latest at the end of the tangential inflow, before entering the conical hollow space 114, in order to obtain optimum air/fuel mixing. On the combustion-space side 122, the outlet opening of the burner 100 merges into a front wall 110 in which there are a number of bores 110*a*. The last-mentioned bores 110*a* come into operation when required and ensure that diluent air or cooling air 110*b* is supplied to the front part of the combustion space 122. Furthermore, this air supply provides for flame stabilization at the outlet of the burner 100. This flame stabilization becomes important when it is a matter of supporting the compactness of the flame as a result of radial flattening. The fuel fed through the nozzle 103 is a liquid or gaseous fuel 112, which if need be may be enriched with a recycled exhaust gas. This fuel 112, in particular if it is a liquid fuel, is injected at an acute angle into the conical hollow space 114. Thus a conical fuel profile 105 forms from the nozzle 103 and is enclosed by the rotating combustion air 115 flowing in tangentially. The concentration of the fuel 112 is continuously reduced in the axial direction by the inflowing combustion air 115 to form optimum mixing. If the burner 100 is operated with a gaseous fuel 113, this preferably takes place via opening nozzles 117, the forming of this fuel/air mixture being achieved directly at the transition of the air-inlet slots 119, 120 to the conical hollow space 114. The injection of the fuel 112 via the nozzle 103 fulfills the function of a head stage; it normally comes into action during start-up and during part-load operation. Base-load operation with a liquid fuel is, of course, also possible via this head stage. The optimum, homogeneous fuel concentration over the cross-section, on the one hand, and the critical swirl coefficient, on the other hand, appear at the end of the burner 100; the critical swirl coefficient, in interaction with the cross-sectional widening disposed there, then leads to a vortex breakdown and at the same time to the formation of a backflow zone 106 there. The ignition is effected at the tip of this backflow zone 106. Only at this point can a stable flame front 107 develop. A flashback of the flame into the interior of the burner 100, as is potentially the case in known premix sections, against which a remedy is attempted with complicated flame retention baffles, need not be feared here. If the combustion air 115 is additionally preheated or enriched with recycled exhaust gas, this provides lasting assistance for the evaporation of the liquid fuel 112, possibly used, before the combustion zone is reached. The same considerations also apply if liquid fuels are supplied via the lines 108, 109 instead of gaseous fuels. Narrow limits are to be adhered to in the configuration of the conical sectional bodies 101, 102 with regard to cone angle and width of the tangential air-inlet slots 119, 120 in order that the desired flow field of the combustion air 115 can arise with the backflow zone 106 at the outlet of the burner. In general, it may be said that a reduction in the tangential air-inlet slots 119, 120 displaces the backflow zone 106 further upstream, although this would then result in the mixture being ignited earlier. Nonetheless, it may be stated that the backflow zone 106, once it is fixed, is positionally stable per se, since the swirl coefficient increases in the direction of flow in the region of the conical shape of the burner 100. The axial velocity inside the burner 100 can be changed by a corresponding feed (not shown) of an axial combustion-air flow. Furthermore, the construction of the burner 100 is eminently suitable for changing the size of the tangential air-inlet slots 119, 120, whereby a relatively large operational range can be covered without changing the overall length of the burner 100. It is also easily possible to nest the conical sectional bodies 101, 102 spiral-like one inside the other.

The geometric configuration of the baffle plates 121*a*, 121*b* is now apparent from FIGS. 4–6. They have a flow-initiating function, extending, in accordance with their length, the respective end of the conical sectional bodies 101, 102 in the oncoming-flow direction relative to the combustion air 115. The ducting of the combustion air 115 into the conical hollow space 114 can be optimized by opening or closing the baffle plates 121*a*, 121*b* about a pivot 123 placed into the conical hollow space 114 in the region of the entry of this duct, and this is especially necessary if the original gap size of the tangential air-inlet slots 119, 120 is changed. These dynamic measures may, of course, also be provided statically by makeshift baffle plates forming a fixed integral part with the conical sectional bodies 101, 102. The burner 100 may likewise be operated without baffle plates, or other aids may be provided for this.

Figure 7:
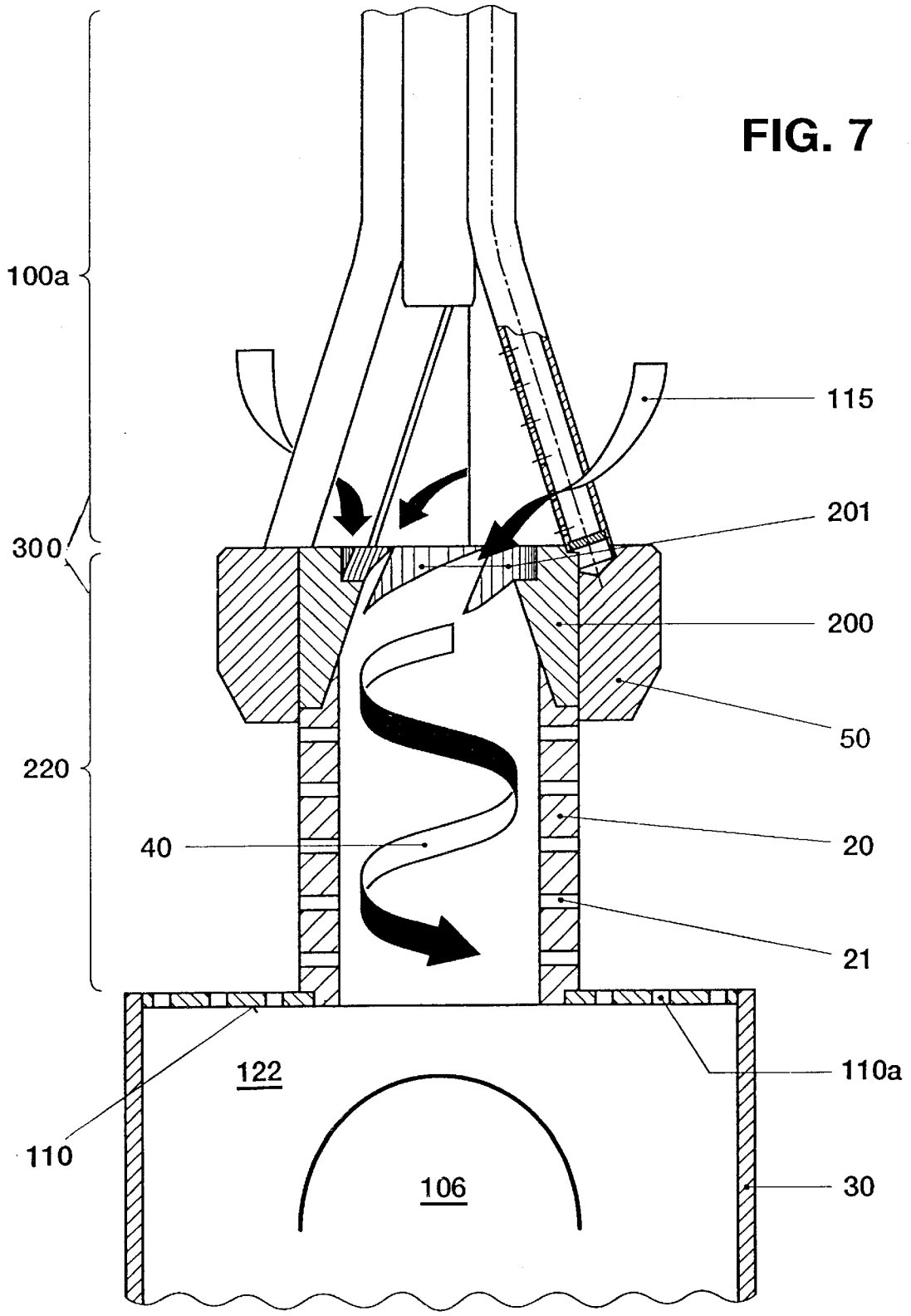
FIG. 7 shows a further burner.

FIG. 7 shows the overall construction of a further burner 300. Initially, a swirl generator 100*a* is effective, the configuration of which largely corresponds to that of the burner 100 according to FIG. 3. This swirl generator 100*a* is also a conical structure to which combustion-air flow 115 entering tangentially is repeatedly admitted tangentially. The flow forming herein, with the aid of a transition geometry provided downstream of the swirl generator 100*a*, is passed over smoothly into a transition piece 200 in such a way that no separation regions can occur there. The configuration of this transition geometry is described in more detail under FIG. 12. This transition piece 200 is extended on the outflow side of the transition geometry by a tube 20, the two parts forming the actual mixing tube 220 of the burner 300. The mixing tube 220 may of course be made in one piece, i.e. by the transition piece 200 and the tube 20 being fused to form a single cohesive structure, the characteristics of each part being retained. If transition piece 200 and tube 20 are constructed from two parts, these parts are connected by a sleeve ring 50, the same sleeve ring 50 serving as an anchoring surface for the swirl generator 100*a* on the head side. In addition, such a sleeve ring 50 has the advantage that various mixing tubes may be used. Located on the outflow side of the tube 20 is the actual combustion space 122, which essentially corresponds to that from FIG. 1 and which is symbolized here merely by a flame tube 30. The mixing tube 220 fulfills the condition that a defined mixing section be provided downstream of the swirl generator 100*a*, in which mixing section perfect premixing of fuels of various types is achieved. Furthermore, this mixing section, that is the mixing tube 220, enables the flow to be directed free of losses so that in the first place no backflow zone can form even in interaction with the transition geometry, whereby the mixing quality for all types of fuel can be influenced over the length of the mixing tube 220. However, this mixing tube 220 has another property, which consists in the fact that in the mixing tube 220 itself the axial velocity profile has a pronounced maximum on the axis so that a flashback of the flame from the combustion chamber is not possible. However, it is correct to say that this axial velocity decreases toward the wall in such a configuration. So that flashback is also prevented in this region, the mixing tube 220 is provided in the flow and peripheral directions with a number of regularly or irregularly distributed bores 21 having the most varied cross-sections and directions, through which an air quantity flows into the interior of the mixing tube 220, and an increase in the velocity is induced along the wall. Another possibility of achieving the same effect is for the cross-section of flow of the mixing tube 220 on the outflow side of the transition passages 201, which form the transition geometry already mentioned, to undergo narrowing, as a result of which the entire velocity level inside the mixing tube 220 is raised. In the figure, the outlet of the transition passages 201 corresponds to the narrowest cross-section of flow of the mixing tube 220. The said transition passages 201 accordingly bridge the respective difference in cross-section without at the same time adversely affecting the flow formed. If the measure selected for directing the tube flow 40 along the mixing tube 220 initiates an intolerable pressure loss, this may be remedied by a diffuser (not shown in the figure) being provided at the end of the mixing tube 220. The flame tube 30 of the combustion space 122 adjoins the end of the mixing tube 220, there being a jump in cross-section between the two cross-sections of flow. Only here does a central backflow zone 106 form, which has the properties of a flame retention baffle. If a fluidic marginal zone forms inside this jump in cross-section during operation, in which marginal zone vortex separations arise due to the vacuum prevailing there, this leads to intensified ring stabilization of the backflow zone 106. At the end face, that is in the front wall 110, a plurality of openings 31 are provided through which an air quantity flows directly into the jump in cross-section and, inter alia, helps there to intensify the ring stabilization of the backflow zone 106. In addition, it must not be left unmentioned that the generation of a stable backflow zone 106 also requires a sufficiently high swirl coefficient in a tube. If such a high swirl coefficient is undesirable in the first place, stable backflow zones may be generated by the feed of small, intensely swirled air flows at the tube end, for example through tangential openings. It is assumed here that the air quantity required for this is approximately 5–20% of the total air quantity.

Figure 8:
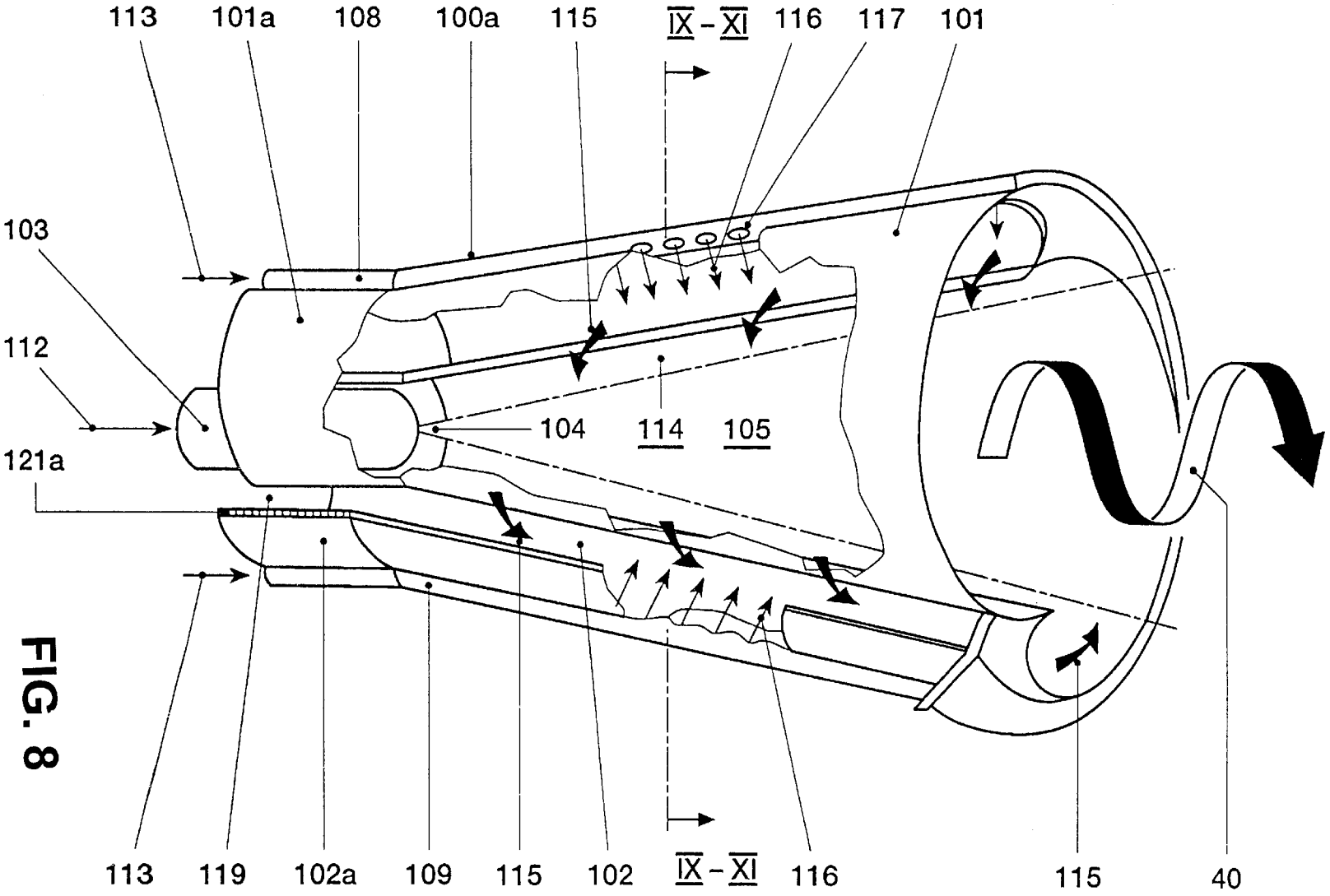
FIG. 8 shows a swirl generator as a component of the burner according to FIG. 7, in perspective representation and appropriate cut-away section.

As already mentioned, the swirl generator 100*a* according to FIG. 8, from the physical configuration, largely corresponds to the burner 100 according to FIG. 3, this swirl generator 100*a* no longer having a front wall. With regard to the differences to be determined here, reference is made to the embodiments under FIG. 7.

Figure 9:
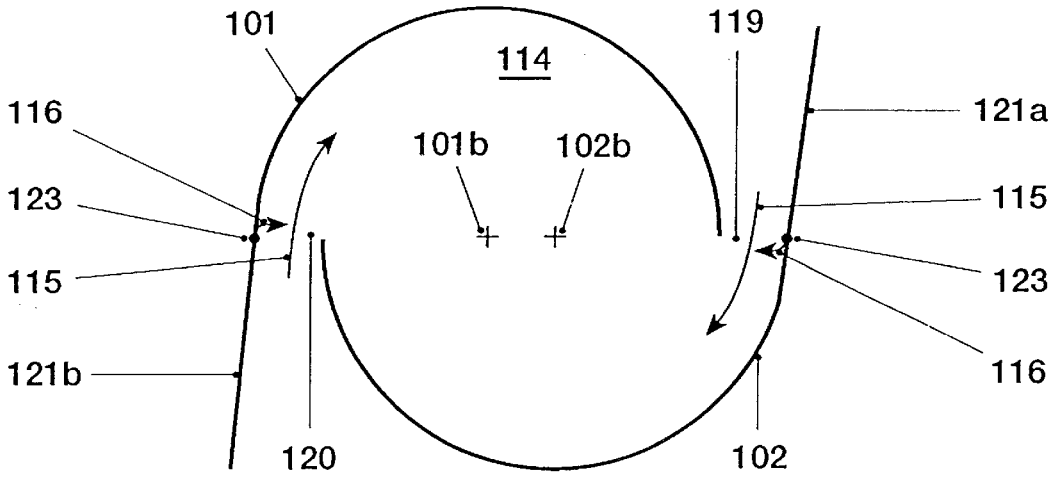
FIG. 9 shows a section plane through the swirl generator according to FIG. 8 designed as a two-shell swirl generator.

With regard to FIG. 9, reference is made to the embodiments under FIGS. 4–6.

Figure 10:
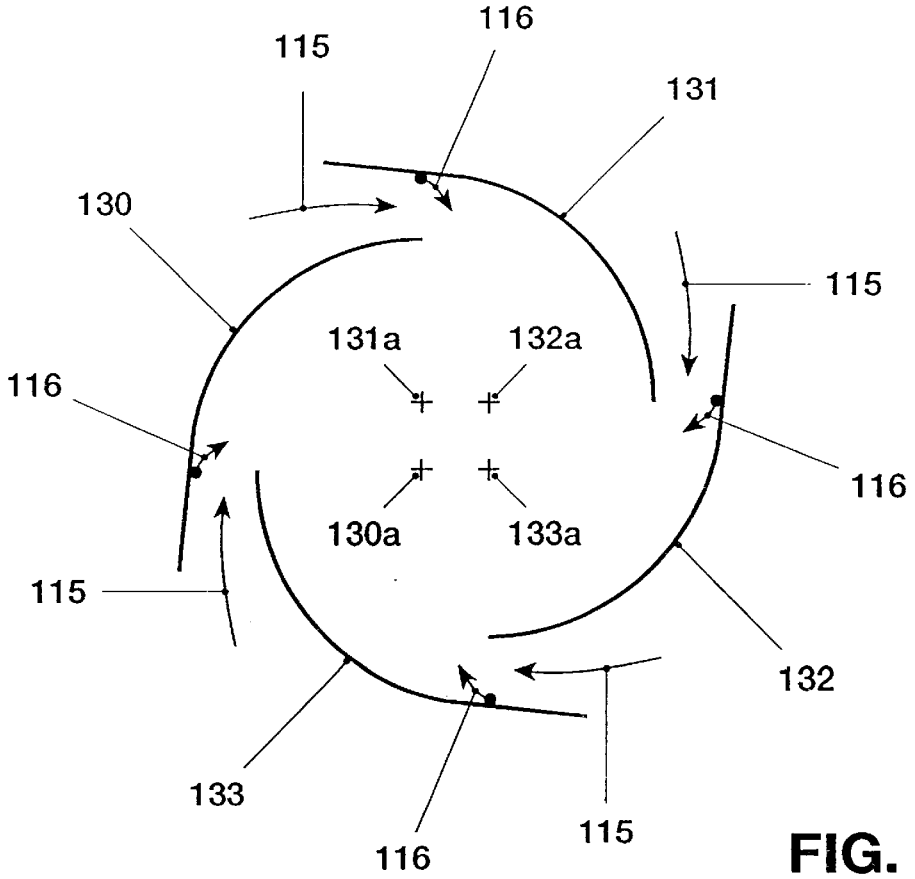
FIG. 10 shows a section plane through a four-shell swirl generator.

FIG. 10, in comparison with FIG. 9, shows that the swirl generator 100*a* is now composed of four sectional bodies 130, 131, 132, 133. The associated longitudinal symmetry axes for each sectional body are identified by the letter a. It may be said of this configuration that, on account of the smaller swirl intensity thus produced and in interaction with a correspondingly increased slot width, it is best suited to preventing the breakdown of the vortex flow on the outflow side of the swirl generator 110*a* in the mixing tube 220, whereby the mixing tube can best fulfill the role intended for it.

Figure 11:
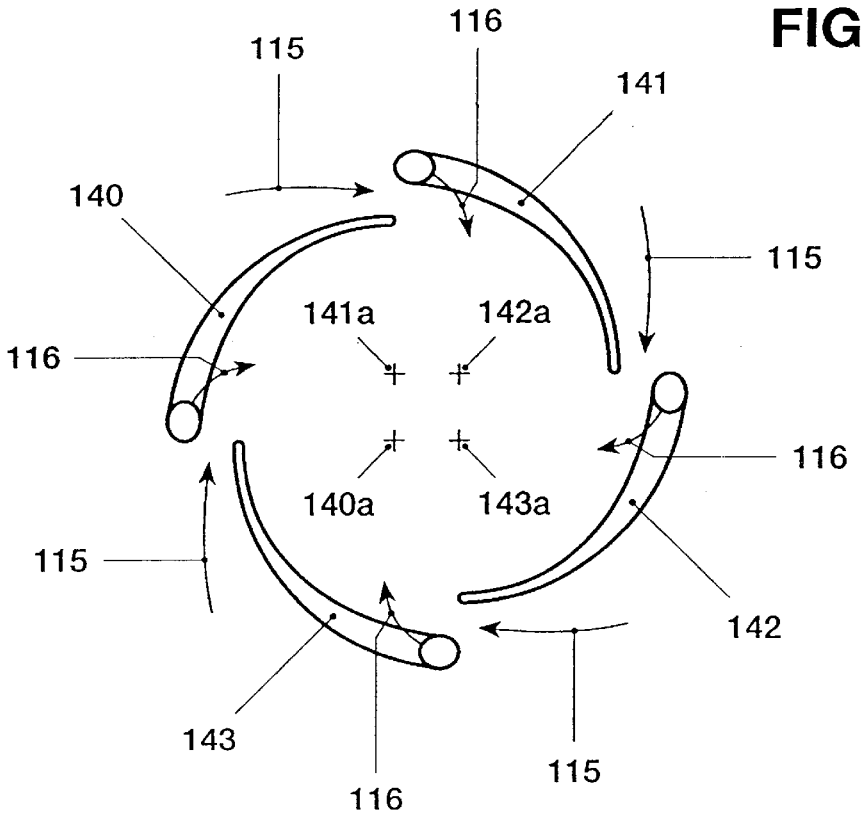
FIG. 11 shows a section plane through a swirl generator whose shells are profiled in a blade shape.

FIG. 11 differs from FIG. 10 inasmuch as the sectional bodies 140, 141, 142, 143 here have a blade-profile shape which is provided for supplying a certain flow. Otherwise, the mode of operation of the swirl generator is kept the same. The admixing of the fuel 116 with the combustion-air flow 115 is effected from the interior of the blade profiles, i.e. the fuel line 108 is now integrated in the individual blades. Here, too, the longitudinal symmetry axes for the individual sectional bodies are identified by the letter a.

Figure 12:
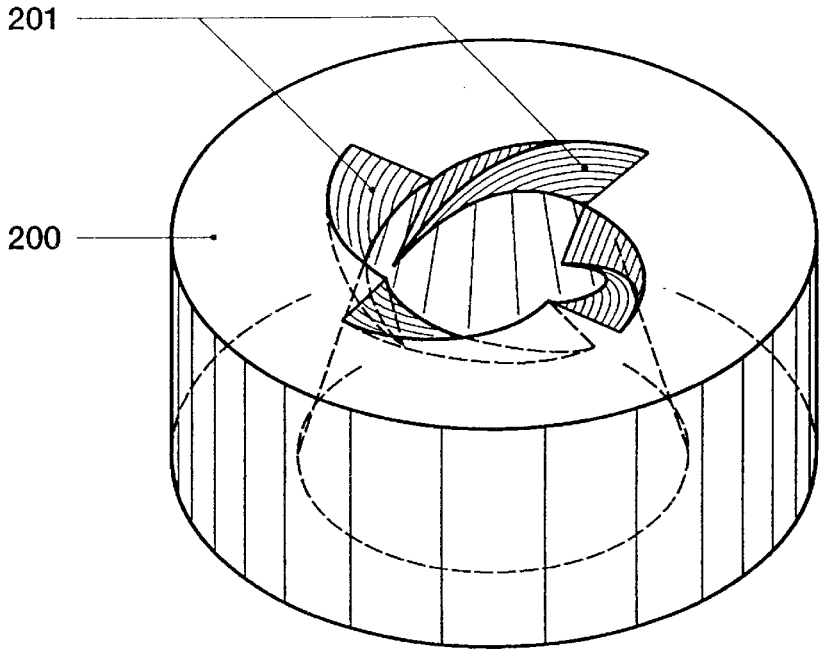
FIG. 12 shows a representation of the form of the transition geometry between swirl generator and downstream mixing tube.

FIG. 12 shows the transition piece 200 in a three-dimensional view. The transition geometry is constructed for a swirl generator 100*a* having four sectional bodies in accordance with FIG. 10 or 11. Accordingly, the transition geometry has four transition passages 201 as a natural extension of the sectional bodies acting upstream, as a result of which the cone quadrants of the said sectional bodies are extended until they intersect the wall of the tube 20 or of the mixing tube 220 respectively. The same considerations also apply when the swirl generator is constructed on the basis of a principle other than that described under FIG. 8. The surface of the individual transition passages 201 which runs downward in the direction of flow has a form which runs spirally in the direction of flow and describes a crescent-shaped path, in accordance with the fact that in the present case the cross-section of flow of the transition piece 200 widens conically in the direction of flow. The swirl angle of the transition passages 201 in the direction of flow is selected in such a way that a sufficiently large section subsequently still remains for the tube flow 40 up to the jump in cross-section at the combustion-chamber inlet in order to effect perfect premixing with the injected fuel. Furthermore, the axial velocity at the mixing-tube wall downstream of the swirl generator is also increased by the abovementioned measures. The transition geometry and the measures in the region of the mixing tube 220 produce a distinct increase in the axial-velocity profile toward the center of the mixing tube, so that the risk of premature ignition is decisively counteracted.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A combustion chamber, comprising:

a plenum for receiving at least one flow of compressor air, at least one burner placed inside the plenum to receive air from the plenum, a wall bounding a combustion space arranged downstream of the plenum, a cooling-air-carrying duct encasing the wall of the combustion space and leading into the plenum, injector systems connecting the cooling-air-carrying duct to the plenum, which injector systems each include a flow duct as a continuation of the cooling-air-carrying duct and have a plurality of openings arranged in a periphery of the flow duct, and means for introducing additional air from outside the cooling-air-carrying duct to accelerate through the openings.

2. The combustion chamber as claimed in claim 1, wherein the combustion chamber is an annular combustion chamber.

3. The combustion chamber as claimed in claim 1, wherein the injector systems are arranged in an annular manner around the wall bounding the combustion space.

4. The combustion chamber as claimed in claim 1, wherein the injector systems project into the plenum.

5. The combustion chamber as claimed in claim 1, wherein the burner includes at least two hollow, conical sectional bodies which are nested one inside the other and extend longitudinally in a flow direction to enclose a conical interior space, and whose respective longitudinal symmetry axes are mutually offset from one another, so that adjacent walls of the sectional bodies define longitudinally extending ducts, for a tangential combustion-air flow into the conical interior space, and having at least one fuel nozzle mounted to inject a fuel in the conical interior space formed by the sectional bodies.

6. The combustion chamber as claimed in claim 5, wherein additional fuel nozzles are arranged to inject additional fuel in a region of the longitudinally extending ducts.

7. The combustion chamber as claimed in claim 5, wherein the sectional bodies widen conically at a fixed angle in the direction of flow.

8. The combustion chamber as claimed in claim 5, wherein the wall bounding the combustion space defines an outwardly extending jump in cross-section between the burner and the combustion space, a region of the combustion space along the jump provided a low pressure zone for a backflow zone.

9. The combustion chamber as claimed in claim 5, wherein the sectional bodies are shaped to have a constantly increasing cone angle in the direction of flow.

10. The combustion chamber as claimed in claim 5, wherein the sectional bodies are shaped to have a constantly decreasing cone angle in the direction of flow.

11. The combustion chamber as claimed in claim 1, wherein the burner includes a swirl generator and a mixing section arranged downstream of the swirl generator, and wherein the mixing section includes a transition part connecting to the swirl generator and a main part downstream of the transition part, wherein the transition part includes transition passages for guiding a swirling flow formed in the swirl generator into the main section.

12. The combustion chamber as claimed in claim 11, wherein the swirl generator includes at least two hollow, conical sectional bodies nested one inside the other and extending in a direction of flow to define a conical interior space, wherein respective longitudinal symmetry axes of the sectional bodies are mutually offset so that adjacent walls of the sectional bodies form longitudinally extending ducts for a tangential a combustion-air flow into the conical interior space, and at least one fuel nozzle arranged to inject fuel into the conical interior space formed by the sectional bodies.

13. The combustion chamber as claimed in claim 12, wherein additional fuel nozzles are arranged to inject additional fuel in a region of the longitudinally extending ducts.

14. The combustion chamber as claimed in claim 12, wherein each of the sectional bodies has a blade-shaped profile in cross-section.

15. The combustion chamber as claimed in claim 11, wherein the mixing section is designed as a tubular mixing element.

16. The combustion chamber as claimed in claim 11, wherein a quantity of the transition passages in the mixing section corresponds to a quantity of the sectional bodies of the swirl generator.

17. The combustion chamber as claimed in claim 11, wherein the main part of the mixing section downstream of the transition passages includes in the direction of flow and in a peripheral direction a plurality of openings as prefilming bores for injection an air flow.

18. The combustion chamber as claimed in claim 11, wherein the main part of the mixing section downstream of the transition passages has a tangential opening for injecting an air flow.

19. The combustion chamber as claimed in claim 11, wherein a cross-section of flow of the main part of the mixing section downstream of the transition passages is not less than a cross-section of the flow formed in the swirl generator.

20. The combustion chamber as claimed in claim 11, wherein the transition passages cover sectors of an end face of the mixing section and run helically in the direction of flow.

21. The combustion chamber as claimed in claim 11, further comprising a diffuser at a downstream end of the mixing section.

22. The combustion chamber as claimed in claim 11, wherein a cross-section of flow of the main part of the mixing section downstream of the transition passages is not greater than a cross-section of the flow formed in the swirl generator.

23. The combustion chamber as claimed in claim 11, wherein the wall bounding the combustion space defines an outwardly extending jump in cross-section between the swirl generator and the combustion space, a region of the combustion space along the jump provided a low pressure zone for a backflow zone.

* * * * *